US007342756B2

(12) United States Patent
Lifson et al.

(10) Patent No.: US 7,342,756 B2
(45) Date of Patent: Mar. 11, 2008

(54) FAULT RECOGNITION IN SYSTEMS WITH MULTIPLE CIRCUITS

(75) Inventors: Alexander Lifson, Manlius, NY (US); Michael F. Taras, Fayetteville, NY (US); Howard H. Fraser, Jr., Woodstock, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/227,253

(22) Filed: Aug. 23, 2002

(65) Prior Publication Data

US 2004/0037017 A1 Feb. 26, 2004

(51) Int. Cl.
*G01K 13/00* (2006.01)

(52) U.S. Cl. ..... 361/22; 62/129

(58) Field of Classification Search ..... 361/22, 361/23, 25, 27, 37; 62/127, 129, 126
See application file for complete search history.

(56) References Cited

U.S. PATENT DOCUMENTS 4,502,842 A * 3/1985 Currier et al. ..... 417/8
4,646,530 A * 3/1987 Huenniger ..... 62/175
5,195,329 A * 3/1993 Lewis et al. ..... 62/117
5,845,509 A * 12/1998 Shaw et al. ..... 62/175
6,067,482 A * 5/2000 Shapiro ..... 700/286
6,142,740 A * 11/2000 Connell ..... 417/2
6,332,327 B1 * 12/2001 Street et al. ..... 62/127
6,394,120 B1 * 5/2002 Wichert ..... 137/2
6,564,565 B2 * 5/2003 Hwang ..... 62/210
2004/0025523 A1 * 2/2004 Bodell et al. ..... 62/228.1

* cited by examiner

*Primary Examiner*—Robert L. Deberadinis
*Assistant Examiner*—Danny Nguyen
(74) *Attorney, Agent, or Firm*—Bachman & LaPointe, P.C.

(57) ABSTRACT

A method for detecting compressor or system degradation or malfunction in a multiple circuit compressor system includes the steps of providing a multiple circuit compressor system including at least a first circuit and a second circuit; and comparing a first value corresponding to an operating parameter of the first circuit with a second value corresponding to an operating parameter of the second circuit.

18 Claims, 1 Drawing Sheet

FAULT RECOGNITION IN SYSTEMS WITH MULTIPLE CIRCUITS

BACKGROUND OF THE INVENTION

The invention relates to fault recognition in compressor systems and, more particularly, to fault recognition in systems with multiple circuits.

Compressors and compressor systems are used in air conditioning and refrigeration systems, among others, and are used for various critical functions.

As with all machines, compressors and compressor systems require maintenance and repair. Unfortunately, in some instances, malfunction of a compressor or compressor system is not readily apparent until potentially serious damage has been done to the compressor, and the compressor has failed resulting in interruption of the required air conditioning and/or refrigeration service.

It is clear that the need exists for mechanisms or methods whereby degradation, malfunction or failure of a compressor can be detected in advance, so that preventive maintenance can be taken and potentially catastrophic failure or interruption in service is avoided.

It is therefore the primary object of the present invention to provide a method for detecting compressor degradation.

It is a further object of the present invention to provide such a method which is simple and effective to implement in new and existing equipment.

It is a further object of the present invention to provide such a method which can be implemented to detect system-wide problems.

Other objects and advantages of the present invention will appear hereinbelow.

SUMMARY OF THE INVENTION

In accordance with the present invention, the foregoing objects and advantages have been readily attained.

According to the invention, a method is provided for detecting compressor degradation in a multiple circuit compressor system, which method comprises the steps of providing a multiple circuit compressor system comprising at least a first circuit and a second circuit; and comparing a first value corresponding to an operating parameter of said first circuit with a second value corresponding to an operating parameter of said second circuit.

In further accordance with the present invention, a multiple circuit compressor system is provided which comprises a first circuit; a second circuit; and means for comparing a first value corresponding to an operating parameter of said first circuit with a second value corresponding to an operating parameter of said second circuit.

BRIEF DESCRIPTION OF THE DRAWINGS

A detailed description of preferred embodiments of the present invention follows, with reference to the attached drawings, wherein.

DETAILED DESCRIPTION

The invention relates to a method for detecting compressor degradation and, more particularly, to a method for use in connection with multiple circuit systems wherein operating parameters or values corresponding to same are measured or otherwise determined in connection with individual circuits and compared to each other.

Operating parameters in multiple circuits are compared to each other under circumstances where they are expected to perform in a substantially uniform manner, within a pre-selected tolerance band, and deviation beyond the tolerance band indicates degradation in performance of one circuit.

In accordance with the present invention, it has been discovered that multiple-circuit compressor systems can be operated in a manner which can be used to detect degradation or malfunction of compressors or compressor systems by measuring one or more operating parameters or values of one circuit, or a first circuit, in the system, and comparing the measured parameter or value to that of a second circuit. Variance of the first measured value from the second measured value which exceeds a pre-selected threshold can indicate degradation or malfunction in operation of one of these circuits, and this indication can then be used to signal for maintenance that can advantageously avoid potentially catastrophic failure of one or more components of the system or interruption in service.

Figure 1:
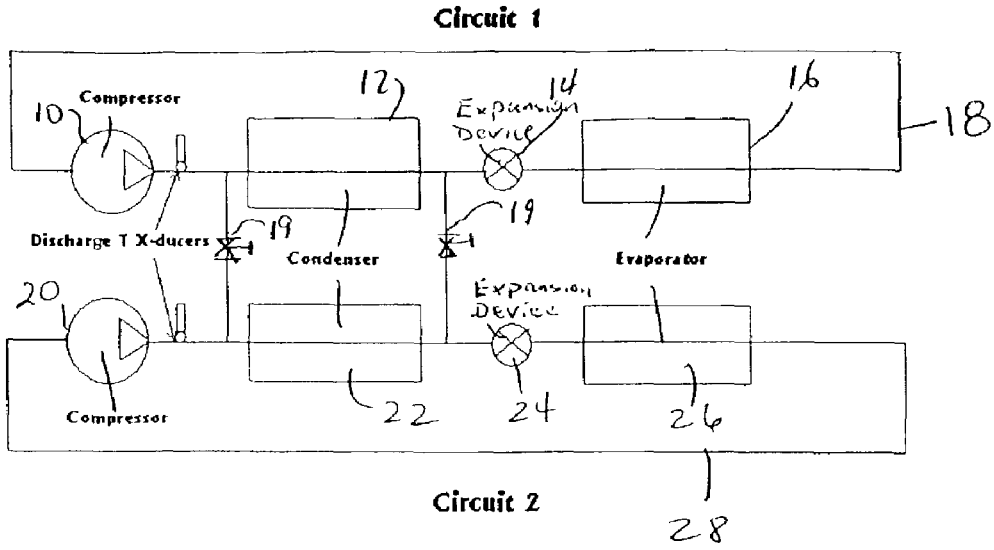
FIG. 1 illustrates an example of an integrated multiple circuit system in accordance with the present invention.

FIG. 1 schematically illustrates such a system in accordance with the present invention, including circuit 1 comprising a compressor 10, condenser 12, expansion device 14 and evaporator 16. These components are connected by a refrigerant loop 18 and function as is well known to a person of ordinary skill in the art to provide the desired function. Circuit 2 likewise includes a compressor 20, condenser 22, expansion device 24, and evaporator 26 which are all connected with a refrigerant loop 28, and which function also as is well known to a person of ordinary skill in the art.

In accordance with the embodiment of the present invention as illustrated in FIG. 1, refrigerant loops 18 and 28 are integrated, or have means to communicate with each other, such that operating parameters in circuit 1 and circuit 2 can readily be compared. This can be accomplished using communication lines between the circuits which can be physically separated by shutoff valves 19 in conventional operation or which can be left open since operating parameters for both circuits are almost identical in most cases.

In accordance with the present invention, the multiple circuit system as illustrated in FIG. 1 can be operated with either or both of compressor 10 and compressor 20. In a normal operating mode, both compressors 10, 20 would typically be used. In order to detect potential compressor degradation, compressor 10 and compressor 20 may advantageously be operated alone for a short period of time independently of the other, and measurements of one or more parameters such as compressor discharge temperature, compressor discharge pressure, compressor suction pressure, compressor power, condenser saturated temperature, evaporator saturated temperature, suction superheat and the like can be measured. It should be appreciated that the operating parameter can be measured directly or indirectly, for example, voltage or current can be measured in order to determine power. Further, an actual reading of the parameter is not needed so long as the value is a quantity which at least corresponds to the parameter in question.

The measured values are preferably provided to a processor unit or some other control unit which is advantageously programmed to compare the values as desired so as to determine a difference therebetween. This difference is then compared to a pre-selected threshold which corresponds to an allowable range or tolerance band of difference between operating parameters from the first and second circuits. This tolerance should take into account, among other factors, the accuracy of equipment used to obtain measurements such as transducers and the like, potential transducer installation variations, compressor manufacturing variations and the like. Of course, depending upon the system in question, other factors may need to be taken into consideration as well when determining a suitable threshold or tolerance band.

In the embodiment shown in FIG. 1, when it is desired to check for compressor degradation, compressor 10 and compressor 20 can advantageously be operated sequentially, with measurements or values being obtained for each operation, and these values can then be compared as described above.

Figure 2:
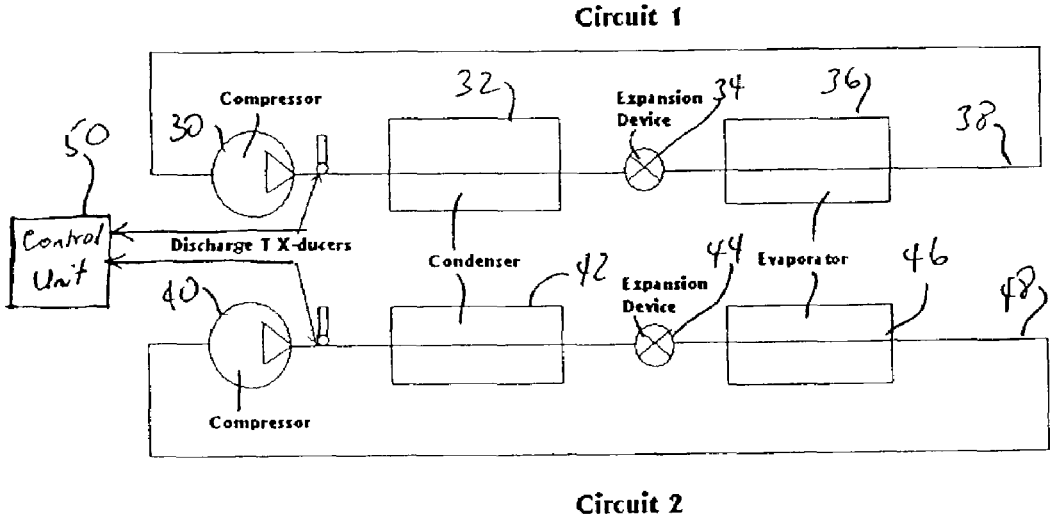
FIG. 2 illustrates a further example of a multiple circuit system with separate circuits also in accordance with the present invention.

Turning to the embodiment of FIG. 2, the method of the present invention applies to systems wherein the multiple circuits are not integrated as well.

As shown, in this embodiment circuit 1 may include a compressor 30, condenser 32, expansion device 34 and evaporator 36, all of which can be connected with a refrigerant loop 38. Circuit 2 likewise can include a compressor 40, condenser 42, expansion device 44, evaporator 46 and refrigerant loop 48 connecting same.

In this embodiment, wherein circuit 1 and circuit 2 are not integrated, measurements can be taken and provided to a control unit 50 which is advantageously programmed to compare the values, and correlate them if necessary, to provide the desired comparison and detection of compressor or system degradation or malfunction.

In this embodiment, it may be necessary to obtain external condition measurements such as indoor and outdoor conditions and the like, and correlate this information with values measured to allow for comparison between circuit 1 and circuit 2 with correlated values. This embodiment advantageously allows for implementation of the method of the present invention without requiring system modifications.

It should be appreciated that the various measurements or values to be obtained in connection with operating parameters of circuits in connection with the present invention can advantageously be obtained using known equipment instrumentation such as simple temperature and pressure transducers and the like, all of which are well known to a person of ordinary skill in the art.

Furthermore, the control member or logic aspect of the present invention involves simple programming which likewise would be well within the skill of the person of ordinary skill in the art in such matters.

It should also be appreciated, however, that the method of the present invention as illustrated in the embodiments of FIGS. 1 and 2 advantageously provides for early detection of compressor degradation or malfunction in a multiple circuit compressor system with little or no modification of existing equipment, and with little or no requirement for microprocessor chip memory. This advantageously allows for such detection of compressor degradation without the need for storing compressor rating data and the like.

As an example, the diagnostic method and system in accordance with the present invention could be adapted to compare measured compressor discharge temperatures against each other. For a compressor whose performance has deteriorated below expectations, the measured discharge temperature will be substantially higher than a normally operating compressor. As another example, if compressor power is to be measured, either directly or indirectly through voltage and current, an increase in compressor power for one compressor would also indicate compressor deterioration. Obviously, other operating parameters can be compared as well, and multiple or additional parameters or values correspond to parameters can be measured and compared for further accuracy in detecting degradation.

In addition, monitoring of operation parameters such as suction pressure, discharge pressure and the like, and comparing them between different circuits, allows detection of system-related problems in similar manner. Thus, the method of the present invention allows fault recognition techniques to be implemented at the system level.

Finally, a further advantage of the present method is an implementation at a factory or other manufacturing facility, wherein the method can be implemented during a run-test.

The method of the present invention can further be implemented in the field during periodic service intervals, or through the use of permanently installed monitoring systems.

The system and method of the present invention further offer these benefits with nominal or no hardware modifications, thus minimizing the cost associated with its implementation.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for detecting compressor degradation in a multiple circuit compressor system comprising steps of providing a multiple circuit compressor system comprising at least a first circuit comprising a first compressor, a first condenser, a first expansion device and a first evaporator and a second circuit comprising a second compressor, a second condenser, a second expansion device and a second evaporator;

comparing a first value corresponding to an operating parameter of said first circuit with a second value corresponding to an operating parameter of said second circuit, wherein the comparing step comprises measuring the first value while the first circuit is operating, measuring the second value while the second circuit is operating, and comparing the first value and the second value; and wherein the comparing step comprises sequentially measuring the first value while the first circuit is operating and the second circuit is not operating and measuring the second value while the second circuit is operating and the first circuit is not operating, and comparing the first value and the second value.

2. The method of claim 1, wherein said comparing step comprises determining a difference between said first value and said second value and comparing said difference to a pre-selected threshold.

3. The method of claim 2, further comprising the step of generating a signal when said difference exceeds said threshold.

4. The method of claim 1, wherein said system further comprises means for communicating said first circuit and said second circuit with each other.

5. The method of claim 4, wherein said first value and said second value are compared in real time.

6. The method of claim 4, wherein said first circuit and said second circuit are integrated.

7. The method of claim 4, wherein said first circuit and said second circuit share at least one component.

8. The method of claim 4, wherein said first circuit and said second circuit share a heat exchanger.

9. The method of claim 1, wherein said first circuit and said second circuit are independent of each other.

10. The method of claim 9, wherein said first value and said second value are compared to each other in real time.

11. The method of claim 1, wherein the first compressor, the first condenser, the first expansion device and the first evaporator are each separate from the second compressor, the second condenser, the second expansion device and the second evaporator.

12. The method of claim 1, wherein the method is carried out at a manufacturing facility in order to run-test one of said first compressor and said second compressor.

13. A method for detecting compressor degradation in a multiple circuit compressor system, comprising the steps of:

providing a multiple circuit compressor system comprising at least a first circuit comprising a first compressor, a first condenser, a first expansion device and a first evaporator and a second circuit comprising a second compressor, a second condenser, a second expansion device and a second evaporator; and comparing a first value corresponding to an operating parameter of said first circuit with a second value corresponding to an operating parameter of said second circuit, further comprising comparing an additional first value corresponding to an additional operating parameter of said first circuit with an additional second value corresponding to an additional operating parameter of said second circuit so as to provide enhanced detection of compressor degradation.

14. A method for detecting compressor degradation in a multiple circuit compressor system, comprising the steps of:

providing a multiple circuit compressor system comprising at least a first circuit comprising a first compressor, a first condenser, a first expansion device and a first evaporator and a second circuit comprising a second compressor, a second condenser, a second expansion device and a second evaporator; and comparing a first value corresponding to an operating parameter of said first circuit with a second value corresponding to an operating parameter of said second circuit, further comprising storing external conditions corresponding to said first value and said second value and correlating at least one of said first value and said second value to provide correlated values that can be compared.

15. A multiple circuit compressor system, comprising:

a first circuit comprising a first compressor, a first condenser, a first expansion device and first evaporator;

a second circuit comprising a second compressor, a second condenser, a second expansion device and a second evaporator;

means for comparing a first value corresponding to an operating parameter of said first circuit with a second value corresponding to an operating parameter of said second circuit;

wherein the means for comparing comprises means for measuring the first value while the first circuit is operating and for measuring the second value while the second circuit is operating, and for comparing the first value and the second value; and wherein the means for comparing comprises means for sequentially measuring the first value while the first circuit is operating and the second circuit is not operating and for measuring the second value while the second circuit is operating and the first circuit is not operating, and for comparing the first value and the second value.

16. The apparatus of claim 15, wherein the first compressor, the first condenser, the first expansion device and the first evaporator are each separate from the second compressor, the second condenser, the second expansion device and the second evaporator.

17. A multiple circuit compressor system, comprising:

a first circuit comprising a first compressor, a first condenser, a first expansion device and a first evaporator;

a second circuit comprising a second compressor, a second condenser, a second expansion device and a second evaporator; and means for comparing a first value corresponding to an operating parameter of said first circuit with a second value corresponding to an operating parameter of said second circuit, wherein the means for comparing further comprises means for comparing an additional first value corresponding to an additional operating parameter of said first circuit with an additional second value corresponding to an additional operating parameter of said second circuit so as to provide enhanced detection of compressor degradation.

18. A multiple circuit compressor system, comprising:

a first circuit comprising a first compressor, a first condenser, a first expansion device and a first evaporator;

a second circuit comprising a second compressor, a second condenser, a second expansion device and a second evaporator; and means for comparing a first value corresponding to an operating parameter of said first circuit with a second value corresponding to an operating parameter of said second circuit, wherein the means for comparing further comprises means for storing external conditions corresponding to said first value and said second value and correlating at least one of said first value and said second value to provide correlated values that can be compared.

* * * * *